US010897956B2

(12) United States Patent
Hopkins

(10) Patent No.: US 10,897,956 B2
(45) Date of Patent: Jan. 26, 2021

(54) FOOTWEAR ARTICLE WITH ASYMMETRIC ANKLE COLLAR

(71) Applicant: NIKE, Inc., Beaverton, OR (US)

(72) Inventor: Timothy P. Hopkins, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 16/230,912

(22) Filed: Dec. 21, 2018

(65) Prior Publication Data

US 2020/0196703 A1 Jun. 25, 2020

(51) Int. Cl.

| | |
|---|---|
| ***A43B 11/00*** | (2006.01) |
| ***A43B 23/04*** | (2006.01) |
| ***A43B 5/00*** | (2006.01) |
| ***A43B 23/02*** | (2006.01) |

(52) U.S. Cl.

CPC ..... *A43B 11/00* (2013.01); *A43B 5/00* (2013.01); *A43B 23/027* (2013.01); *A43B 23/047* (2013.01)

(58) Field of Classification Search

CPC ..... A43B 11/00; A43B 11/02; A43B 21/32; A43B 23/088; A43B 23/027; A43B 23/045; A43B 23/047; A43B 23/28; A43C 11/002; A43C 11/006; A43C 11/008

USPC ..... 36/51, 69, 45, 89, 92, 102, 105, 138

See application file for complete search history.

(56) References Cited

U.S. PATENT DOCUMENTS

| | | | | |
|---|---|---|---|---|
| 91,547 | A * | 6/1869 | Leathe | A43B 23/047 36/51 |
| 219,436 | A * | 9/1879 | Beneke | A43B 23/047 36/51 |
| 827,330 | A | 7/1906 | Tillson | |
| 863,549 | A | 8/1907 | Metz | |
| 911,025 | A * | 2/1909 | Blaisdell | A43B 23/047 36/51 |
| 1,028,598 | A | 6/1912 | Papp | |
| 1,081,678 | A | 12/1913 | Meyer | |
| 1,155,354 | A | 10/1915 | Hallock | |
| 1,275,895 | A | 8/1918 | Eox | |
| 1,494,236 | A | 5/1924 | Greathouse | |
| 1,686,175 | A | 10/1928 | Read | |
| D98,150 | S * | 1/1936 | Drake | 36/51 |
| 2,069,752 | A | 2/1937 | Dorr | |
| 2,097,810 | A * | 11/1937 | Dawes | A43C 11/002 36/51 |
| 2,450,250 | A | 9/1948 | Napton | |

(Continued)

FOREIGN PATENT DOCUMENTS

| | | |
|---|---|---|
| CN | 2438353 Y | 7/2001 |
| CN | 1403041 A | 3/2003 |

(Continued)

OTHER PUBLICATIONS

Prosecution of U.S. Appl. No. 15/493,582, filed Apr. 21, 2017.

(Continued)

*Primary Examiner* — Jameson D Collier

(74) *Attorney, Agent, or Firm* — Shook, Hardy & Bacon L.L.P.

(57) ABSTRACT

A footwear article includes an asymmetric ankle collar that may expand in a manner that facilitates donning and doffing the footwear article, such as when the wearer slides his or her heel out of the footwear article. The footwear article may also include a collar elevator.

11 Claims, 9 Drawing Sheets

(56) References Cited

U.S. PATENT DOCUMENTS

| | | | | |
|---|---|---|---|---|
| 2,452,502 | A | 10/1948 | Tarbox | |
| 2,736,110 | A | 2/1956 | Hardimon | |
| 2,920,402 | A | 1/1960 | Minera | |
| 3,146,535 | A | 9/1964 | Owings | |
| 3,192,651 | A | 7/1965 | Smith | |
| 4,489,509 | A | 12/1984 | Libit | |
| 4,972,613 | A | 11/1990 | Loveder | |
| 5,054,216 | A | 10/1991 | Lin | |
| 5,090,140 | A | 2/1992 | Sessa | |
| 5,181,331 | A | 1/1993 | Berger | |
| 5,184,410 | A | 2/1993 | Hamilton | |
| 5,282,327 | A | 2/1994 | Ogle | |
| 5,317,819 | A | 6/1994 | Ellis, III | |
| 5,341,583 | A | 8/1994 | Hallenbeck | |
| 5,371,957 | A | 12/1994 | Gaudio | |
| 5,467,537 | A | 11/1995 | Aveni et al. | |
| 5,481,814 | A | 1/1996 | Spencer | |
| 5,826,353 | A | 10/1998 | Woznicki | |
| 5,842,292 | A | 12/1998 | Siesel | |
| 6,000,148 | A | 12/1999 | Cretinon | |
| 6,189,239 | B1 | 2/2001 | Gasparovic et al. | |
| 6,314,662 | B1 | 11/2001 | Ellis | |
| 6,360,454 | B1 | 3/2002 | Dachgruber et al. | |
| 6,378,230 | B1 | 4/2002 | Rotem et al. | |
| 6,557,271 | B1 | 5/2003 | Weaver, III | |
| 6,684,533 | B1 | 2/2004 | Su | |
| 6,925,732 | B1 | 8/2005 | Clarke | |
| 6,938,361 | B2 | 9/2005 | Su | |
| 7,103,994 | B2 | 9/2006 | Johnson | |
| 7,225,563 | B2 | 6/2007 | Chen et al. | |
| 7,392,603 | B1 | 7/2008 | Shepherd et al. | |
| 7,439,837 | B2 | 10/2008 | McDonald | |
| 7,685,747 | B1 | 3/2010 | Gasparovic et al. | |
| 7,793,438 | B1 | 9/2010 | Busse et al. | |
| 7,823,299 | B1 | 11/2010 | Brigham | |
| 7,975,403 | B2 | 7/2011 | Mosher | |
| 8,020,317 | B1 | 9/2011 | Sokolowski | |
| D648,512 | S | 11/2011 | Schlageter et al. | |
| 8,056,264 | B2 * | 11/2011 | Sato | A43B 13/181 36/114 |
| 8,065,819 | B2 | 11/2011 | Kaufman | |
| 8,161,669 | B2 | 4/2012 | Keating | |
| 8,769,845 | B2 * | 7/2014 | Lin | A43B 9/02 36/138 |
| 9,820,527 | B2 * | 11/2017 | Pratt | A43B 23/28 |
| 10,455,898 | B1 | 10/2019 | Orand et al. | |
| 10,617,174 | B1 | 4/2020 | Hopkins et al. | |
| 2002/0112376 | A1 | 8/2002 | Tomat | |
| 2002/0144434 | A1 | 10/2002 | Farys et al. | |
| 2004/0111921 | A1 * | 6/2004 | Lenormand | A43B 5/003 36/45 |
| 2005/0039348 | A1 | 2/2005 | Raluy et al. | |
| 2005/0081404 | A1 | 4/2005 | Hurd et al. | |
| 2006/0032091 | A1 | 2/2006 | Kilgore | |
| 2007/0074425 | A1 | 4/2007 | Leong | |
| 2007/0256332 | A1 | 11/2007 | Calderone | |
| 2008/0083138 | A1 * | 4/2008 | Lacorazza | A43B 3/26 36/97 |
| 2008/0086911 | A1 | 4/2008 | Labbe | |
| 2008/0120871 | A1 * | 5/2008 | Sato | A43B 13/181 36/88 |
| 2008/0155788 | A1 | 7/2008 | Wilcox | |
| 2008/0307673 | A1 | 12/2008 | Johnson | |
| 2011/0016751 | A1 | 1/2011 | Somerville | |
| 2011/0146106 | A1 | 6/2011 | Kaufman | |
| 2011/0185592 | A1 | 8/2011 | Nishiwaki et al. | |
| 2012/0079742 | A1 | 4/2012 | Ferreira et al. | |
| 2012/0180338 | A1 | 7/2012 | Lin | |
| 2012/0192453 | A1 | 8/2012 | Raysse et al. | |
| 2012/0317839 | A1 * | 12/2012 | Pratt | A43B 11/00 36/102 |
| 2013/0219747 | A1 | 8/2013 | Lederer | |
| 2014/0173935 | A1 * | 6/2014 | Sabbioni | A43B 1/10 36/87 |
| 2015/0305432 | A1 | 10/2015 | Wiens | |
| 2017/0099908 | A1 * | 4/2017 | Lee | A43D 3/02 |
| 2017/0303632 | A1 | 10/2017 | Pratt et al. | |
| 2018/0098601 | A1 | 4/2018 | Hartenstein et al. | |
| 2018/0110292 | A1 * | 4/2018 | Beers | A43B 3/0036 |
| 2018/0289109 | A1 * | 10/2018 | Beers | A43B 21/32 |
| 2018/0338583 | A1 | 11/2018 | Sullivan | |

FOREIGN PATENT DOCUMENTS

| | | | | |
|---|---|---|---|---|
| CN | 201005111 | Y | 1/2008 | |
| DE | 3928625 | A1 * | 3/1991 | A43B 5/00 |
| DE | 19534249 | A1 | 3/1997 | |
| DE | 19611797 | A1 * | 10/1997 | A43B 11/00 |
| DE | 29809404 | U1 | 9/1998 | |
| DE | 10247163 | A1 | 4/2004 | |
| DE | 102004005288 | A1 | 8/2005 | |
| EP | 0149362 | A2 | 7/1985 | |
| EP | 1059044 | A1 | 12/2000 | |
| FR | 1083503 | | 1/1955 | |
| FR | 1474203 | A * | 3/1967 | A43C 11/002 |
| GB | 503525 | A * | 4/1939 | A43C 11/002 |
| GB | 2517148 | A | 2/2015 | |
| GB | 2517399 | A | 2/2015 | |
| JP | 181910 | A | 6/1989 | |
| JP | 2001149394 | A | 6/2001 | |
| JP | 2005-532115 | A | 10/2005 | |
| JP | 2006055571 | A | 3/2006 | |
| JP | 2012-61046 | A | 3/2012 | |
| WO | 2007080205 | A1 | 7/2007 | |
| WO | WO-2009154350 | A1 * | 12/2009 | A43B 11/02 |
| WO | 2010/059716 | A2 | 5/2010 | |
| WO | 2016/002412 | A1 | 1/2016 | |

OTHER PUBLICATIONS

Prosecution of U.S. Appl. No. 13/509,780, filed May 14, 2012.
Prosecution of U.S. Appl. No. 15/693,195, filed Aug. 31, 2017.
Prosecution of U.S. Appl. No. 15/690,679, filed Aug. 30, 2017.
Prosecution of U.S. Appl. No. 15/934,740, filed Mar. 23, 2018.
Non-Final Office Action dated Mar. 1, 2019 in U.S. Appl. No. 16/230,907, 28 pages.
International Search Report and Written Opinion received for PCT Patent Application No. PCT/US2019/067599, dated Jun. 25, 2020, 15 pages.

* cited by examiner

FOOTWEAR ARTICLE WITH ASYMMETRIC ANKLE COLLAR

TECHNICAL FIELD

This disclosure relates to a footwear article having an asymmetric ankle collar having medial-side properties that are different from lateral-side properties.

BACKGROUND

Some footwear articles include an ankle collar that is manipulated when the footwear article is put on. For example, the ankle collar may be depressed towards the sole as the wearer's foot is slid into the upper. Furthermore, some of these footwear articles include a collar elevator operable to move the ankle collar from the depressed or lowered state to the raised state. An example of one type of collar elevator is described in U.S. Pat. No. 9,820,527, and examples of other collar elevators are described in US Pat. Pub. 2018/0110292 and US Pat. Pub. 2018/0289109.

BRIEF DESCRIPTION OF THE DRAWINGS

Some subject matter described in this disclosure makes reference to drawing figures, which are incorporated herein by reference in their entirety.

DETAILED DESCRIPTION

Figure 1:
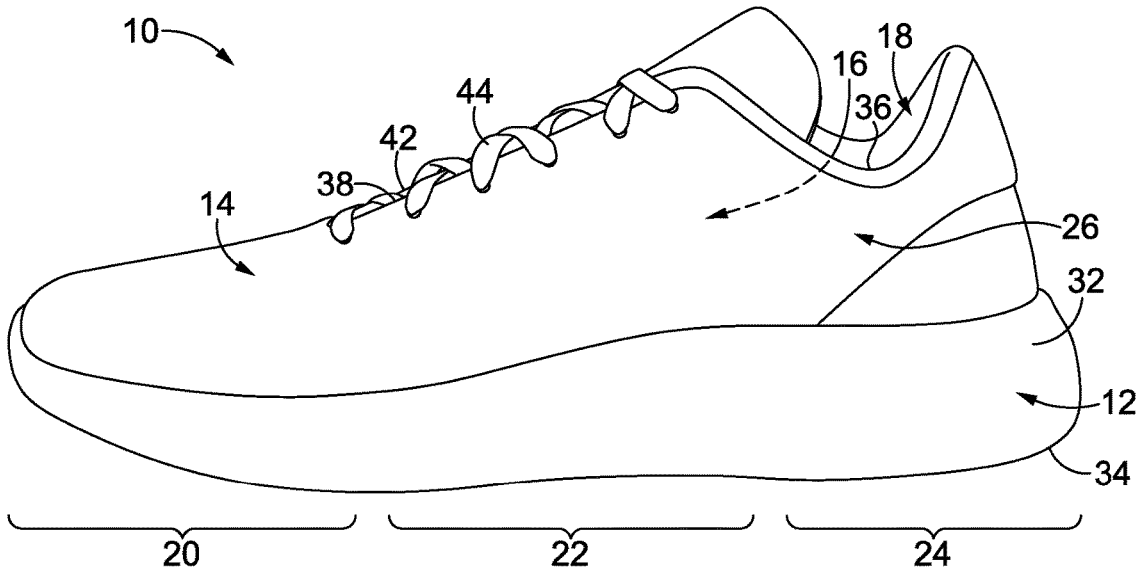
FIG. 1 depicts a side view of a footwear article in accordance with an aspect of this disclosure.

Subject matter is described throughout this Specification in detail and with specificity in order to meet statutory requirements. The aspects described throughout this Specification are intended to be illustrative rather than restrictive, and the description itself is not intended necessarily to limit the scope of the claims. Rather, the claimed subject matter might be practiced in other ways to include different elements or combinations of elements that are equivalent to the ones described in this Specification and that are in conjunction with other present technologies or future technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the claims.

The subject matter described in this Specification generally relates to, among other things, a footwear article having an asymmetric ankle collar, including manufactures and methods associated therewith. In some aspects, the asymmetric ankle collar may expand in a manner that facilitates donning and doffing the footwear article, such as when the wearer slides his or her heel out of the footwear article. Some aspects of this disclosure are directed to a footwear article with an asymmetric ankle collar and a collar elevator.

Before describing the figures in more detail, some additional explanation will now be provided related to certain terminology that may be used in this disclosure.

"A," "an," "the," "at least one," and "one or more" might be used interchangeably to indicate that at least one of the items is present. When such terminology is used, a plurality of such items might be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives might be employed throughout this detailed description corresponding to the illustrated examples. Ordinary skilled artisans will recognize that terms such as "above," "below," "upward," "downward," "top," "bottom," etc., may be used descriptively relative to the figures, without representing limitations on the scope of the invention, as defined by the claims.

The term "longitudinal," as possibly used throughout this detailed description and in the claims, refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse," as possibly used throughout this detailed description and in the claims, refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical," as possibly used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region, and/or a throat of an upper. The term "downward" or "downwards" refers to the vertical direction pointing opposite the upwards direction, toward the bottom of a component, and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" shall refer to the direction toward the interior of the component or article of footwear, such as a shoe, and the terms "outward" and "outwardly" shall refer to the direction toward the exterior of the component or article of footwear, such as a shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

Figure 2:
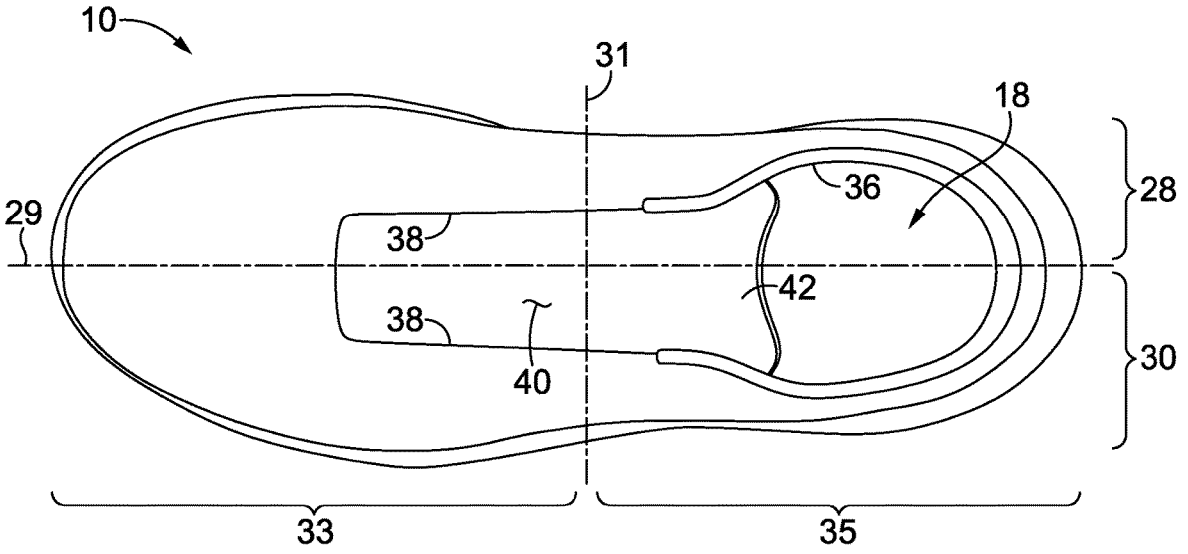
FIG. 2 depicts a top view of the footwear article of FIG. 1 in accordance with an aspect of this disclosure.

In order to aid in the explanation of, and understanding of, aspects of this Specification, reference is now made to FIGS. 1 and 2 to describe elements of a typical footwear article 10, which may include a tongue reinforcer. FIG. 1 depicts a lateral side of the footwear article 10, and FIG. 2 depicts a top of the footwear article. When describing the various figures mentioned in this disclosure, like reference numbers refer to like components throughout the views.

The footwear article 10 includes at least two primary elements including a sole structure 12 and an upper 14. When the footwear article 10 is worn (as intended on a foot), the sole structure 12 is typically positioned near the foot plantar surface (i.e., the bottom of the foot). The sole structure 12 may protect the bottom of the foot, and in addition, may attenuate ground-reaction forces, absorb energy, provide traction, and control foot motion, such as pronation and supination. The upper 14 is coupled to the sole structure 12, and together with the sole structure 12, forms a foot-receiving cavity 16. That is, while the sole structure 12 typically encloses the bottom of the foot, the upper 14 extends over, and at least partially covers, a dorsal portion of the foot (i.e., the top of the foot or the instep) and secures the footwear article 10 to the foot. The upper 14 includes a foot-insertion opening 18, through which a foot is inserted when the footwear article 10 is put on as the foot is arranged into the foot-receiving cavity 16.

As indicated in FIG. 1, the footwear article 10 may include a forefoot region 20, a midfoot region 22, a heel region 24, and an ankle region 26. The forefoot region 20, the midfoot region 22, and the heel region 24 extend through the sole structure 12 and the upper 14. The ankle region 26 is located in a portion of the upper 14. The forefoot region 20 generally includes portions of the footwear article 10 corresponding with the toes and the joints connecting the metatarsals with the phalanges. The midfoot region 22 generally includes portions of the footwear article 10 corresponding with the arch area and instep of the foot. The heel region 24 corresponds with rear portions of the foot, including the calcaneus bone. The ankle region 26 corresponds with the ankle. The forefoot region 20, the midfoot region 22, the heel region 24, and the ankle region 26 are not intended to demarcate precise areas of the footwear article 10, and are instead intended to represent general areas of the footwear article 10 to aid in the understanding of various aspects of this Specification. In addition, portions of a footwear article may be described in relative terms using these general zones. For example, a first structure may be described as being more heelward than a second structure, in which case the second structure would be more toeward and closer to the forefoot.

The footwear article 10 also has a medial side 28 (identified in FIG. 2 and obscured from view in FIG. 1) and a lateral side 30 (identified in FIG. 2 and viewable in FIG. 1). The medial side 28 and the lateral side 30 extend through each of the forefoot region 20, the midfoot region 22, the heel region 24, and the ankle region 26, and correspond with opposite sides of the footwear article 10, each falling on an opposite side of a longitudinal midline reference plane 29 of the footwear article 10, as is understood by those skilled in the art. For example, the longitudinal midline reference plane 29 may pass through the foremost point of the sole structure and the rearmost point of the sole structure. The medial side 29 is thus considered opposite to the lateral side 30. Typically, the lateral side corresponds with an outside area of the foot (i.e., the surface that faces away from the other foot), and the medial side corresponds with an inside area of the foot (i.e., the surface that faces toward the other foot). In another aspect, the footwear article includes an anterior portion 33 and a posterior portion 35, falling on an opposite side of a latitudinal midline reference plane 31 of the footwear article 10. The latitudinal midline reference plane 31 extends perpendicular to the longitudinal midline reference plane 29 and to the ground-surface plane and is spaced evenly between the foremost point of the footwear article 10 and the rearmost point of the footwear article 10. In addition, these terms may also be used to describe relative positions of different structures. For example, a first structure that is closer to the inside portion of the footwear article might be described as medial to a second structure, which is closer to the outside area and is more lateral.

In describing a footwear article, the relative terms "inferior" and "superior" may also be used. For example, the superior portion generally corresponds with a top portion that is oriented closer towards a person's head when the person's feet are positioned flat on a horizontal ground surface and the person is standing upright, whereas the inferior portion generally corresponds with a bottom portion oriented farther from a person's head and closer to the ground surface.

The sole structure 12 may be constructed of various materials and may include various elements. For example, the sole structure 12 may include a midsole 32 and an outsole 34. The midsole 32 may be formed from a compressible polymer foam element (e.g., a polyurethane or ethylvinylacetate (EVA) foam) that attenuates ground reaction forces (i.e., provides cushioning) when compressed between the foot and the ground during walking, running, or other ambulatory activities. In further aspects, the midsole 32 may incorporate fluid-filled chambers, plates, moderators, or other elements that further attenuate forces, enhance stability, or influence motions of the foot. The midsole 32 may be a single, one-piece midsole, or could be multiple components integrated as a unit. In some aspects, the midsole 32 may be integrated with the outsole 34 as a unisole. The outsole 34 may be one-piece, or may be several outsole components, and may be formed from a wear-resistant rubber material that may be textured to impart traction and/or may include traction elements such as tread or cleats secured to the midsole 32. The outsole 34 may extend either the entire length and width of the sole or only partially across the length and/or width.

The upper 14 may also be constructed of various materials and may include various features. For example, the upper 14 may be constructed of leather, textiles, or other synthetic or natural materials. Further, the upper 14 may be a knit textile, woven, braided, non-woven, laminate, or any combination thereof. The upper 14 may have various material properties related to breathability, stretch, flexibility, wicking, water resistance, and the like.

The upper 14 typically includes a portion that overlaps with, and is connected to, the sole structure 12, and the junction of this connection may be referred to as a biteline. In addition, the upper 14 may include a "strobel," which includes a material panel extending from the upper 14 and across at least a portion of a foot-facing surface of the sole structure 12, and the strobel may be used to hold the upper 14 on a last when the sole structure 12 is attached to the upper 14. Stated differently, the sole structure 12 that is integrated into the footwear article 10 includes a foot-facing surface, and in some instances, the upper 14 may include a panel (referred to as a strobel) that extends inward from near the biteline region and at least partially covers the foot-facing surface. In that instance, the strobel is positioned underneath a foot when the footwear article is worn. The strobel may be covered by an insole or other layer of material.

The upper 14 includes other features. For example, the upper 14 includes an ankle collar 36 that forms a perimeter around at least a portion of the foot-insertion opening 18. In addition, the upper 14 includes a throat 38 that often extends from the ankle collar 36 and forms a perimeter along at least one or more sides of an elongated opening 40. A tongue 42 is located in the elongated opening 40, and a size of the elongated opening 40 can be adjusted using various closure systems. For example, FIG. 1 illustrates laces 44, and other closure systems may include elastic bands, hook-and-loop straps, zippers, buckles, and the like. The position of the tongue 42 and the connections of the closure system can be adjusted to vary a size of the foot-insertion opening and the elongated opening, such as by making the openings larger when the footwear article is being donned or doffed and by making the openings smaller when the footwear article is being secured onto a foot. As will be described in other portions of this disclosure, the tongue 42 might include a tongue reinforcer, which might help the tongue maintain a shape and position when the tongue is subjected to forces or adjustments, such as from other footwear-article elements or from a wearer.

The footwear article 10 might include an athletic-type shoe, such as might be worn when running or walking, and the description of the footwear article 10, including the elements described with respect to FIGS. 1 and 2, might also be applicable to other types of shoes, such as basketball shoes, tennis shoes, American football shoes, soccer shoes, leisure or casual shoes, dress shoes, work shoes, a sandal, a slipper, a boot, hiking shoes, and the like.

Figure 3A:
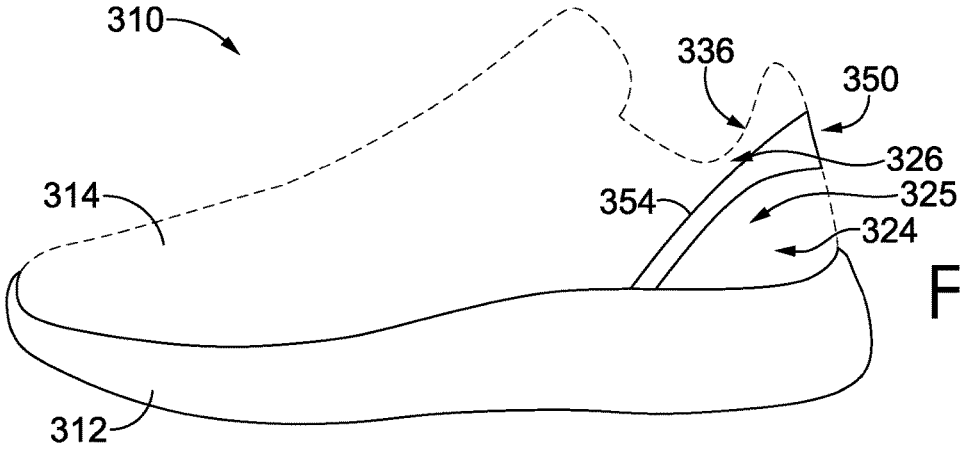
FIGS. 3A-3C depict another footwear article having a collar elevator in accordance with an aspect of this disclosure.
Figure 3B:
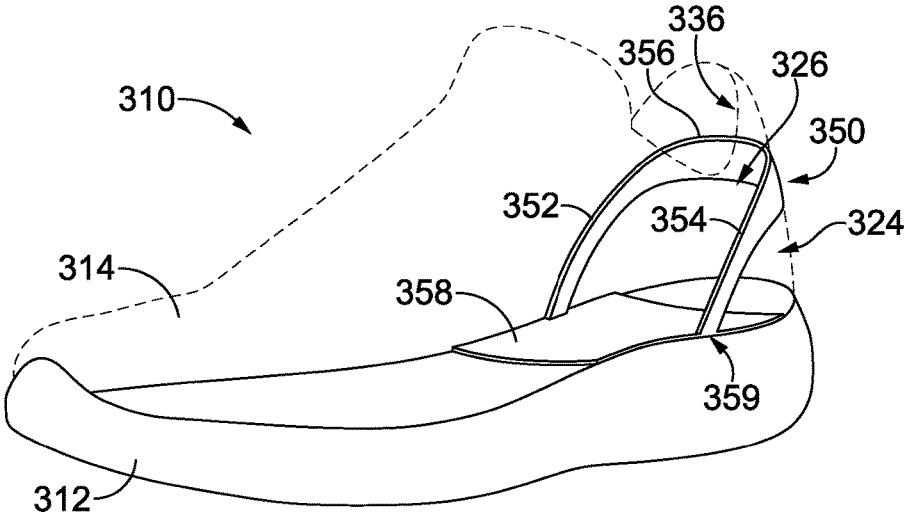
Figure 3C:
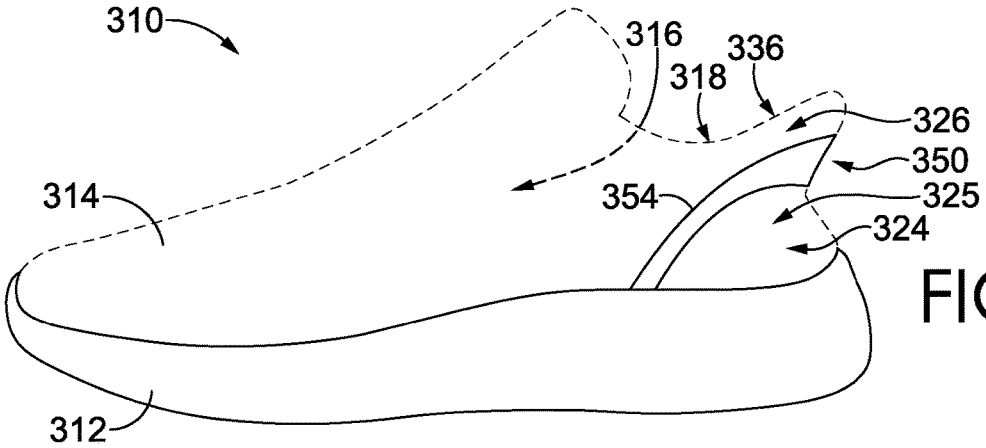

Having described FIGS. 1 and 2, reference is now made to FIGS. 3A-3C and 4A-4C to describe some other aspects of this disclosure. Each of FIGS. 3A, 3B, and 3C depicts a footwear article 310, which includes an upper 314 coupled to a sole 312, and the upper 314 includes a heel region 324 and an ankle region 326 with an ankle collar 336. The ankle collar 336 is movable between a lowered state (as depicted in FIG. 3C) and a raised state (as depicted in FIGS. 3A and 3B). In the lowered state, the ankle collar 336 is positioned closer to the sole 312, and in the raised state, the ankle collar 336 is positioned farther from the sole 312. Similarly, the footwear article 410 includes an upper 414 coupled to a sole 412, and the upper 414 includes a heel region 424 and an ankle region 426 with an ankle collar 436.

Figure 4A:
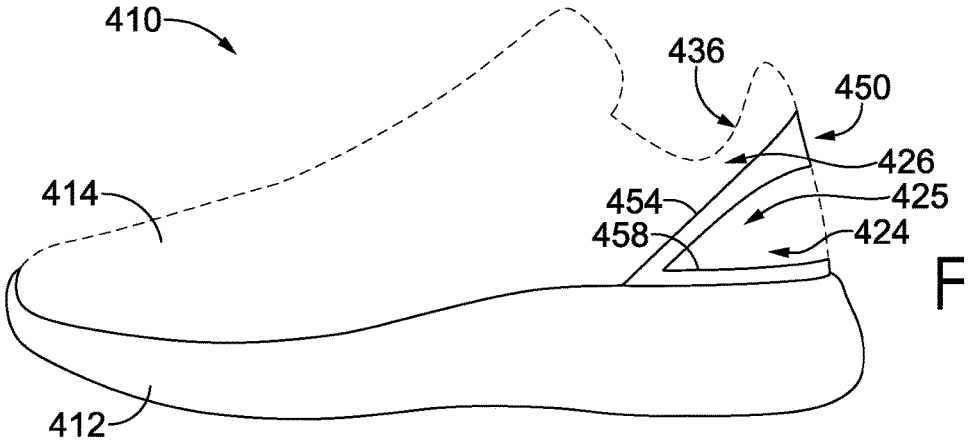
FIGS. 4A-4C depict another footwear article having an alternative collar elevator in accordance with an aspect of this disclosure.
Figure 4B:
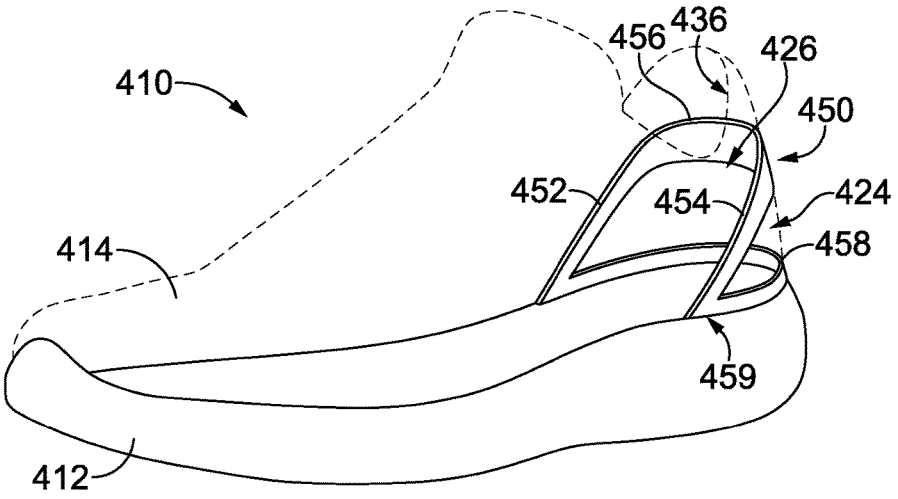
Figure 4C:
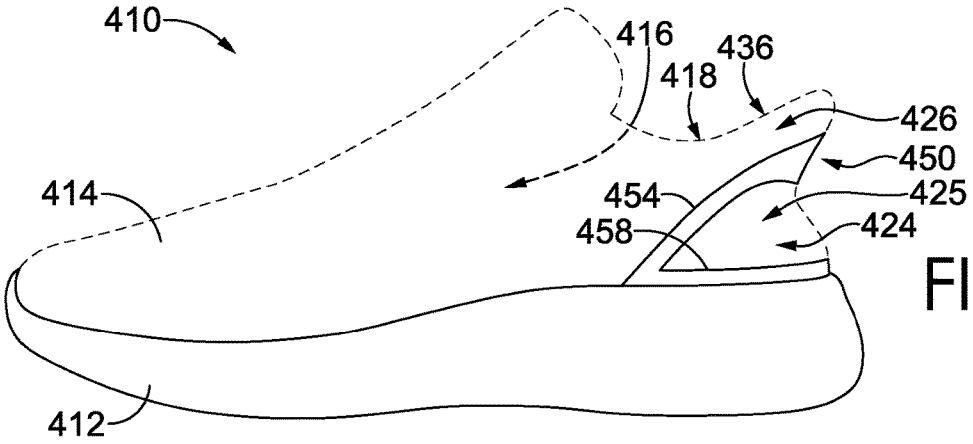

Furthermore, the footwear article 310 includes a collar elevator 350 that is coupled to the upper 314 near the heel region 324 and/or the ankle region 326 and that is operable to move the ankle collar 336 from the lowered state to the raised state. More specifically, the collar elevator 350 includes portions that are positioned in the heel region 324 and that extend up into the ankle region 326. As previously, indicated, there are not necessarily precise delineations between the heel region 324 and the ankle region 326; rather, describing the positioning of the collar elevator 350 with respect to these regions is one way to describe that the collar elevator 350 extends from a more inferior part closer to the sole to a more superior part closer to the ankle collar 336. As far as the coupling of the collar elevator 350 to the upper 314 near the heel region 324 and/or near the ankle region 326, this coupling may take various forms. For example, the collar elevator 350 may be coupled to the upper in the heel region 324, in the ankle region 326, to the ankle collar 336, or any and all combinations thereof. The collar elevator 350 is an example of one type of collar elevator operable to move an ankle collar from the lowered state to the raised state, and as will be described in other portions of this disclosure, a collar elevator may include one or more alternative structures than those depicted in FIGS. 3A-3C. For example, FIGS. 4A-4C depict a footwear article 410 with a collar elevator 450 that is operable to move the ankle collar 436 from the lowered state (e.g., FIG. 4C) to the raised state (e.g., FIGS. 4A and 4B) and that has a different structure from the collar elevator 350.

For illustrative purposes, the upper 314 and the upper 414 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

A collar elevator (such as the collar elevators 350 and 450) may include various elements. In one aspect, a collar elevator includes a medial lever arm, a lateral lever arm, and a center connecting band that couples the medial lever arm to the lateral lever arm and that is located in a heel portion of the ankle collar. In a further aspect, each lever arm is affixed to a base, which remains stationary relative to the lever arms as the lever arms deform when the ankle collar is moved to a lowered state. The base may be a portion of the footwear article, such as a portion of the sole or a portion of the upper. In addition, the base may be one or more other anchors affixed directly or indirectly to the sole, the sole itself, or any combination thereof. U.S. Pat. No. 9,820,527 describes one or more collar elevators, some of which may be referred to as a deformable member or as deformable members (with or without a base), and the full disclosure of U.S. Pat. No. 9,820,527 is incorporated herein by reference in its entirety. In accordance with an aspect of this disclosure, at least some of the deformable members described in U.S. Pat. No. 9,820,527 include a medial lever arm, a lateral lever arm, and a center connecting band that couples the medial lever arm to the lateral lever arm. In other examples, US 2018/0110292 and US 2018/0289109 each describes a plurality of other collar elevators, some of which are referred to as a control bar (with or without a base), and the full disclosures of US 2018/0110292 and US 2018/0289109 are incorporated herein by reference in their entirety. In accordance with an aspect of this disclosure, at least some of the control bars described in US 2018/0110292 and US 2018/0289109 include a medial lever arm, a lateral lever arm, and a center connecting band that couples the medial lever arm to the lateral lever arm.

Each of the illustrated collar elevators 350 and 450 depicts examples of medial lever arms 352 and 452, respectively. In addition, each of the illustrated collar elevators 350 and 450 depicts examples of lateral lever arms 354 and 454, respectively, and center connecting bands 356 and 456, respectively. Furthermore, the lever arms 352 and 354 attach to a base 358, and the lever arms 452 and 454 attach to a base 458 having a different structure from the base 358. The base 358 is affixed to or near a foot-facing surface of the sole 312, and the base 358 might be a portion of an outsole, a portion of a midsole, a portion of an insole, a portion of a strobel, a plate or sheet of material layered between any of these sole layers, or any combination thereof. Among other things, the base 358 might include a rigid portion or section to which the lever arms 352 and 354 are anchored. FIGS. 4A-4C depict a different aspect, in which the base 458 might attach to a portion of the upper (e.g., a heel counter), a portion of the midsole sidewall, or any combination thereof, and the base 458 wraps around a backside of the footwear article, as opposed to extending through the footbed in the manner described with respect to the base 358.

The medial lever arm, the lateral lever arm, and the center connecting band may be a single continuous body, such that clear demarcation may not exist between the medial lever arm, the lateral lever arm, and the center connecting band. For example, the medial and lateral arms and the center connecting band may be molded, cast, 3D printed, or otherwise formed as a single, integrally formed unit. In other aspects, the medial lever arm and the lateral lever arm may be discrete, separate, and distinct elongated members, which are connected to the center connecting band, such as by a mechanical or chemical coupling, a friction fit, sheathing, or other coupling.

Having generally described some of the structural elements of a collar elevator, some operational aspects of a collar elevator will now be described. As briefly described above, the collar elevator moves the ankle collar from the lowered state to the raised state. More specifically, at least a portion of the medial lever arm, the lateral lever arm, the center connecting band, or any combination thereof, is affixed to a portion of the upper. In one aspect, the center connecting band may be affixed near a heel portion of the ankle collar. For example, as described in other portions of this disclosure, the center connecting band may be attached to the heel portion of the ankle collar by an adhesive, connection tab, heat stake, stitch, and the like. As such, when the ankle collar is moved to a lowered state closer to the sole, the medial lever arm and the lateral lever arm deform to a more compressed or more loaded position. Stated differently, the collar elevator stores potential energy by elastically deforming from a less compressed configuration (e.g., FIGS. 3A and 4A) to a more compressed configuration (e.g., FIGS. 3C and 4C) when an applied force moves the ankle collar from the raised state to the lowered state. The potential energy returns the collar elevator to the less compressed configuration upon removal of the applied force, and since the collar elevator is affixed to the upper, the ankle collar is also moved from the lowered state to the raised state. While the compression of the collar elevator may be greater when the ankle collar is moved to the lowered state (as compared with the raised state), in the raised state the collar elevator may still store potential energy in an at least partially deformed state (i.e., preloaded compression) so as to be able to hold a rear, heel portion of the ankle collar about the heel of the wearer. For example, if the collar elevator is attached to the upper heel region and/or the upper ankle region, then portions of the upper may hold or retain the collar elevator in the preloaded configuration when the ankle collar is in the raised state. In other aspects, the collar elevator may be unloaded when the ankle collar is in the raised state.

In one aspect, the portion 325 or 425 of the upper below the center connecting band may include wall of one or more textiles that are more flexible than other portions of the upper. This more flexible region of the upper may, for example, be at least partially in the heel-counter region. Among other things, this more flexible portion 325 or 425 of the upper may collapse more easily when the ankle collar is moved to a lower state and may provide less resistance for the collar elevator (as compared with a less flexible upper in other parts of the footwear article or in a typical footwear article) when the collar elevator is returning to the less compressed state.

In some aspects, the combination of the medial lever arm, the lateral lever arm, and the center connecting band may be referred to as a deformable element. The term "deformable element" refers to a resiliently flexible member that can be bent or compressed but has a bias to move towards a non-bent or uncompressed state. The deformable element may include a single, integrally formed, deformable element, extending continuously from the medial lever arm to the lateral lever arm. In other aspects, the medial lever arm and the lateral lever arm may be two or more separate and distinct deformable elements that connect to the center connecting band, which may also be referred to as a heel piece.

In some aspects, the deformable element might be directly coupled, mounted, or attached to the base. In other aspects, the base may include one or more anchors that engage and retain the deformable element in place. For example, anchors may be located at a junction (e.g., 359 and 459) between the lever arms and the base. Such anchors might be integrally formed with, coupled to and/or located within or between or outside of portions of the sole (e.g., insole, midsole, outsole). For example, an anchor may be disposed in a block, plate, or wedge layered among, on top, or beneath the sole. In some instances, a portion of the sole (e.g., midsole) might be carved or cut out to attach to or house an anchor. In another aspect, a base extending in the mediolateral orientation (e.g., base 358) includes an anchor-shaped receptacle into which an anchor engages by way of a resistance fit, compression fit, a snap fit, or via an interlocking mechanism/configuration. In other examples, the anchors may be integrally formed with, coupled to, and/or located within, between, or outside of portions of the upper. For example, anchors may be located in the upper, in a heel counter, or any combination thereof. A single anchor may extend a full width of the footwear article, or two anchors may be positioned on opposing sides of the footwear article (e.g., on the medial and lateral sides). The deformable member may attach to the base or to an anchor at an angle. For example, the deformable member might attach at a perpendicular angle to the base and then curve or arc rearwardly. In another aspect, the deformable member might attach at a forwardly inclining angle (i.e., upwards and forwards) or a rearwardly reclining angle (i.e., upwards and rearwards) before rearwardly arcing.

A connection between the deformable member and the base or the anchors may be described in various manners. For example, in one aspect, the deformable element does not pivot (i.e., is non-pivoting) about the base (e.g., about an insole, midsole, or outsole). Described differently, the deformable element may be non-rotatably coupled to the base. In various aspects, engagement between the deformable element and the base (or anchor) is free of play, meaning that there is little or no relative movement between the two components.

A deformable element may include one or more of a tube, a wire, a spring, a shape memory structure or material, and the like. Furthermore, a deformable element can include one or more materials such as carbon steel, stainless steel, titanium, nickel titanium (nitinol) and other metals and alloys (shape-memory or otherwise), polymers (shape-memory or otherwise), composite materials, foam materials, graphite, carbon fiber, fiberglass, thermoplastic polyester elastomers (TPC-ET), silicone, thermoplastic polyurethane (TPU), and polycarbonate. For example, a deformable element might include titanium or be a titanium wire. Also, one or more deformable elements might be made of a first material, e.g., titanium, and one or more additional deformable elements might be made of a second material, e.g., graphite.

In some aspects, the deformable element might include a single, unitary piece. For instance, a first end of the deformable element (e.g., an end of the medial lever arm) might be embedded in, or attached to, a medial anchor; a second end of the deformable element (e.g., an end of the lateral lever arm) might be embedded in or attached to a lateral anchor; and a middle portion of the deformable element (e.g., the center connecting band) might extend around the heel portion or ankle portion of the upper, or be embedded within some additional heel-piece structure.

In other aspects, the deformable element might include a plurality of separate and distinct components. For instance, a deformable element might include two separate components, with a first component (e.g., medial lever arm) having a first end embedded in or attached to a medial anchor and a second end embedded in or attached to the medial side of a heel piece or center connecting band. As such, a second component (e.g., lateral lever arm) might similarly include a first end embedded in or attached to a lateral anchor and a second end embedded in or attached to the lateral side of the heel piece or center connecting band. The plurality of separate and distinct components can be secured together, for example, with one or more of a tape wrap, woven encasing, overmold (e.g., TPU), heat shrink tube, and the like, each of which can provide different stabilities and strengths. For example, a deformable element might include one or more wires encased independently or encased together in a cover, sleeve, overmold, or heat shrink tube. The one or more wires can arch, bend, and sway and then return to an initial/normal state in order to help facilitate the elastic deformation of the deformable element.

A deformable element might have variable mechanical properties along its length and/or at distinct points along its length. Such variation might be provided by the deformable element (e.g., by a wire or bundle of two or more wires), by a securement surrounding all or a portion of the deformable element(s), or any combination thereof. For example, the deformable element and/or the securement might have a variable cross-section, a variable density, a variable material, and/or the like along its length. A variable cross-section, in turn, can be provided by variation in thickness or shape, or twisting of the deformable element otherwise having a constant thickness or shape along its length.

As briefly described above, a deformable element may include a cover, sleeve, overmold, or other suitable structure, which might protect other elements (e.g., wire, spring, etc.) of the deformable element and might control, guide, support and/or otherwise affect the flexure or compression of the deformable element. In some aspects, the cover, based on its material of manufacture, shape, geometry, etc., is configured to facilitate mechanical stress distribution by transferring mechanical bending/deforming forces from the deformable element (e.g., from the wire(s) or spring) to the cover to prevent, or at least inhibit, the deformable element from damage or breakage that may otherwise result from the concentrated and repeated mechanical stress experienced by the deformable element. For example, the cover may have dimensions that vary along its length, such as a funnel-like tapering shape, to help distribute stress and contribute to the dynamic flexing of the deformable element. In the event that the deformable element breaks, the cover might still provide at least some degree of bias, thereby still helping to move the ankle collar from the lowered position to the raised position. Further, the cover may provide additional padding and/or support to the deformable element and may prevent, or at least inhibit, a wearer from feeling the deformable element.

As briefly described above, the center connecting band may also be referred to as a heel piece. The center connecting band may be integrally formed with the medial and lateral lever arms, as a single, continuous unit. In other aspects, the center connecting band may be a separate piece that extends between, and bridges, the medial and lateral lever arms. Among other things, the center connecting band may provide a coupling to the upper and may provide a frame to the ankle collar, to inhibit the ankle collar from collapsing into the foot-receiving opening when a foot is being inserted.

When being put on by a wearer, a footwear article with a collar elevator (e.g., collar elevators 350 and 450) might be slipped on by the wearer without the wearer using his or her hands to manipulate the footwear article. For example, the wearer's toes may be inserted through the foot-insertion openings 318 or 418, while the arch or heel of his or her foot is used to press downward on the ankle collars 336 or 436 towards the soles 312 or 412. This adjustment of the ankle collar 336 or 436 into the lowered state closer to the sole may increase a size of the foot-insertion opening 318 or 418. Once the wearer's foot has been slid into the foot-receiving cavity 316 or 416, the collar elevator 350 or 450 moves the ankle collar from the lowered state (i.e., FIGS. 3C and 4C) to the raised state (i.e., FIGS. 3A and 4A) to help secure the footwear article to the wearer's foot.

Among other things, the collar elevators 350 and 450 may reduce potential structural breakdown of the upper heel region and upper ankle region over time, which could result from repeated hands-free donning, by providing a frame operational to return to, or bias in, the raised state. Furthermore, the collar elevators 350 and 450 may allow the user to more easily don (i.e., put on) his or her shoes without the use of hands and/or without having to bend down to tie the laces, without having to use a shoe horn, or without using other such adjustment features, elements, or mechanisms for fit. Moreover, the footwear articles 310 and 410 may more easily receive, or more easily direct a wearer's foot into, or otherwise accommodate, a wearer's foot with respect to, the foot-receiving opening. This potentially easier donning may result from, among other things, the collar elevators 350 and 450 helping to provide a larger foot-insertion opening without allowing a topline of the ankle collar to fold inward towards the foot-receiving cavity.

Operation of the footwear articles 310 and 410 may be described in various manners. For example, the ankle collars 336 and 436 may be elastic or may include a goring element that permits expansion of the foot-insertion openings 318 and 418, such as when the ankle collar is moved to a lowered state. In the lowered state, the foot-insertion openings 318 and 418 may be expanded by at least about 5%, or at least about 10%, or at least about 15%. This measured expansion may be detected in various manners. For example, a first circumference of the foot-insertion opening may be measured when the ankle collar is in a first state, and a second circumference may be measured when the ankle collar is in a second state, which is closer to the sole (relative to the first state). The distance of the ankle collar from the sole in the first and second states may be measured in a vertical plane (i.e., perpendicular relative to the horizontal reference plane, including a flat ground surface on which the ground-contacting surface sits in an at-rest position), and the distance may be measured from a rearmost point of the ankle collar topline edge to a topline edge of the sole (e.g., where the sole connects to the upper at the biteline). As such, the distance in the first state will be longer than the distance in the second state, and in one aspect, the second distance is equal to or shorter than 75% of the first distance. Continuing with the above example, in the second state having the distance equal to or shorter than 75% of the distance in the first state, the circumference may be expanded by at least about 5%, or at least about 10%, or at least about 15%. In a further example, a circumference of the foot-insertion openings 318 and 418 may be expandable by at least about 1.0 inch (about 2.54 centimeters), when the ankle collar is in the second state having the distance equal to or shorter than 75% of the distance in the first state. An amount of the expansion of the foot-insertion opening 318 and 418 may vary with the shoe style and size. In other aspects, a height of the ankle collars 336 and 436 above the soles 312 and 412 in the lowered state is about 50% lower than the height in the raised state, however, as with other parameters, this may vary depending on the shoe style and size.

As described in other portions of this disclosure, the collar elevators 350 and 450 provide a return force when moving the ankle collars 336 and 436 from the lowered state to the raised state. In some aspects, the return force is between about 1 pound-force and about 15 pound-force, and this may be measured at various positions of the ankle collar. For example, as explained above, the ankle collar may include a first state having a first distance from the sole and a second state having a second distance from the sole, which is shorter than the distance in the first state. In one aspect, the collar elevators 350 and 450 provide the return force between about 1 pound-force and about 15 pound-force in the second state having the distance equal to or shorter than about 85% of the distance in the first state. In a further aspect, the collar elevators 350 and 450 provide the return force between about 1 pound-force and about 15 pound-force in the second state having the distance equal to or shorter than about 75% of the distance in the first state. Further still, the collar elevators 350 and 450 might provide the return force between about 1 pound-force and about 15 pound-force in the second state having the distance equal to or shorter than about 50% of the distance in the first state. The return force may be strong enough such that the rear of the ankle collar rebounds back up from the second state and snugly fits around the wearer's heel. For example, the ankle collars 336 and 436 may be elevated from the lowered state to the raised state in less than about 1 second, when the distance between the ankle collar and the sole in the lowered state is shorter than 85%, or shorter than 75%, or shorter than 50% of the distance in the raised state. In other aspects, ankle collars 336 and 436 may be elevated from the lowered state to the raised state in less than about 0.5 seconds, when the distance between the ankle collar and the sole in the lowered state is shorter than 85%, or shorter than 75%, or shorter than 50% of the distance in the raised state. And in further aspects, the ankle collars 336 and 436 may be elevated from the lowered state to the raised state in less than about 0.2 seconds, when the distance between the ankle collar and the sole in the lowered state is shorter than 85%, or shorter than 75%, or shorter than 50% of the distance in the raised state. This rebound time is measured absent any counteracting external forces, such as friction that might be imparted by the wearer's heel.

Referring now to FIGS. 5-9, another footwear article 510 is described having an upper 514 coupled to a sole 512. The upper 514 includes a heel region 524 and an ankle region 526 having an ankle collar 536. The ankle collar 536 is movable between a lowered state (e.g., FIG. 8) positioned closer to the sole 512 and a raised state (e.g., FIGS. 5 and 6) positioned farther from the sole 512. In addition, the footwear article 510 includes a collar elevator 550 coupled to the heel region 524 of the upper, to the ankle region 526 of the upper, near or to the ankle collar 536, or to any combination thereof, and operable to move the ankle collar 536 from the lowered state to the raised state. For example, as explained in other portions of this disclosure, the center connecting band 556 may be affixed to (or near) the rear portion of the ankle collar 536, and/or the lever arms 552 and 554 may be affixed to the heel region 524 of the upper. The collar elevator 550 is an example of one type of collar elevator, and in other aspects of this disclosure, the footwear article 510 may include any of a variety of other collar elevators disclosed in this specification. The upper 514 is tongue-less, such that the vamp extends all the way from the forefoot region up to the front, topline edge of the ankle collar 536. In an alternative aspect, the upper 514 might include a throat (e.g., 38), a tongue (e.g., 42), and a closure system (such as hook-and-loop straps, elastic bands, laces 44, and the like).

In an aspect of the disclosure, the ankle collar 536 includes an ankle-collar, medial-side portion 560; an ankle-collar, lateral-side portion 562; and an ankle-collar, rear-transverse portion 564 that wraps around the back side and connects the medial-side portion 560 and the lateral-side portion 562. In FIGS. 5-9, the portions 560, 562, and 564 extend continuously from one to another, such that the ankle collar 536 continuously extends from the medial side, through the rear transverse portion, and to the lateral side. The portions 560, 562, and 562 are not necessarily intended to provide precise demarcations along the ankle collar 536, and may be helpful when describing the relative positioning of features.

In another aspect of the disclosure, the ankle collar 536 is asymmetric and includes a first set of structures or properties in the medial-side portion 560 that are different from a second set of structures or properties in the lateral-side portion 562. For example, in one aspect of this disclosure, the ankle collar 536 includes a gusset 570 along the medial-side portion 560 without a corresponding gusset along the lateral-side portion 562.

Figure 8:
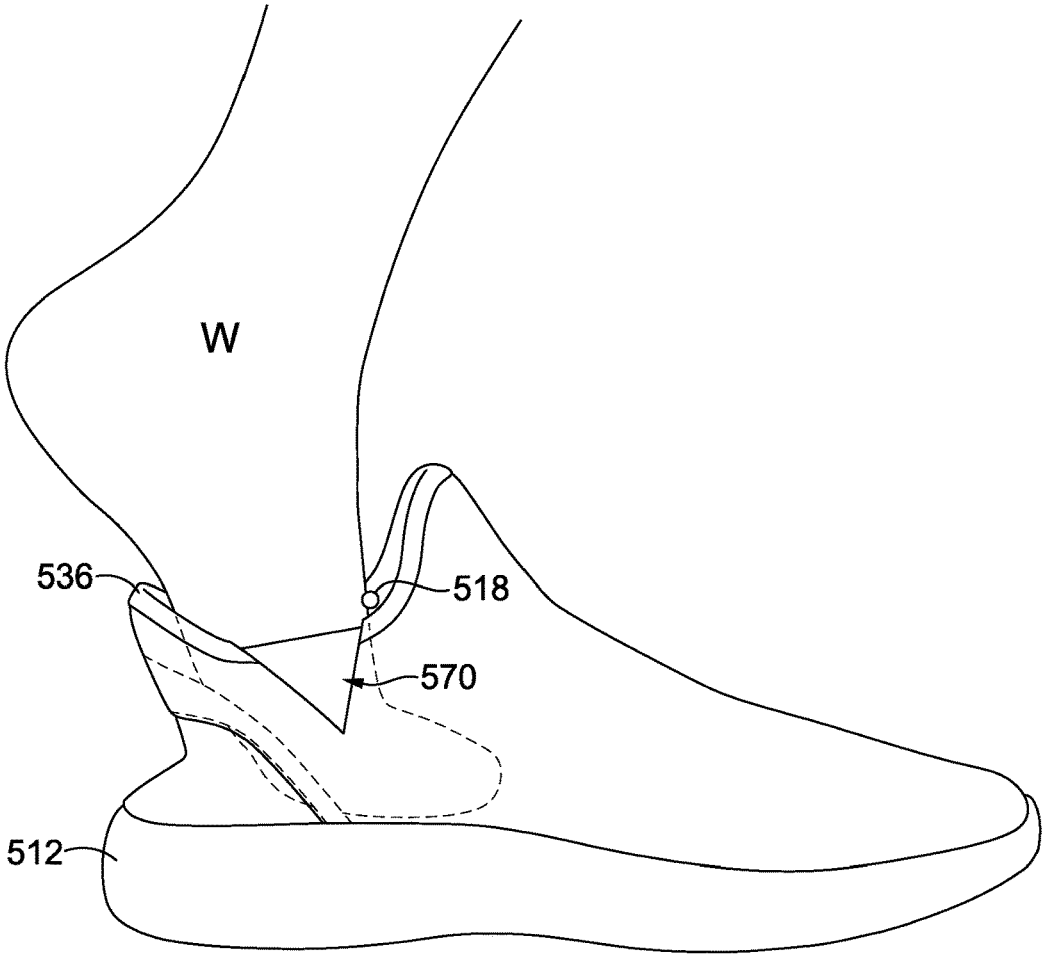

As used in this disclosure, a "gusset" includes a piece of a textile (e.g., panel or strip) that is affixed to, and expands, a portion of the ankle collar. For example, the gusset 570 may include an elastic material that includes a first, at-rest state, that stretches when the ankle collar is depressed (such as when a wearer is slipping his or her foot through the foot-insertion opening), and that returns to the first, at-rest state when the ankle collar returns to the raised position. In this sense, the gusset 570 provides a temporary expansion of the ankle collar 536, which may also increase a size of the foot-insertion opening 518. In one aspect, the ankle collar 536 includes a v-shaped notch 537 in a topline edge 571, and the v-shaped notch 537 tapers from a wider mouth 539 along the topline edge 571 to a narrower base 541 as the v-shaped notch 537 extends from the topline edge 571 towards the sole 512. In addition, the elastic material of the gusset 570 spans the v-shaped notch 537 to permit temporary expansion of the ankle collar 536 along the topline edge 571. For example, FIG. 8 provides an illustration of a wearer W inserting his or her left foot through the foot-insertion opening 518 and using his or her foot to depress the ankle collar 536 (e.g., in the rear-transverse portion 564). As illustrated in FIG. 8, the gusset 570 is in a more stretched or elongated state than the at-rest state depicted in FIG. 6. The gusset 570 is depicted as mostly unobscured. For example, the gusset may be affixed to the upper around the edges of the gusset material panel. In some other instances, a gusset may include a strip of material, and at least part of the strip may be encased between material layers of the ankle collar or of the ankle region.

Figure 5:
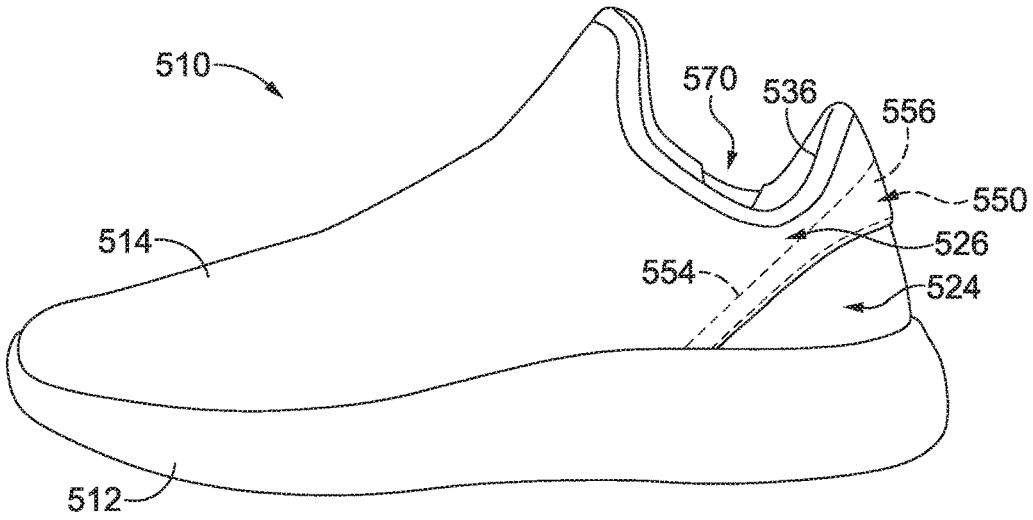
FIGS. 5-9 depict another footwear article in accordance with an aspect of this disclosure.
Figure 6:
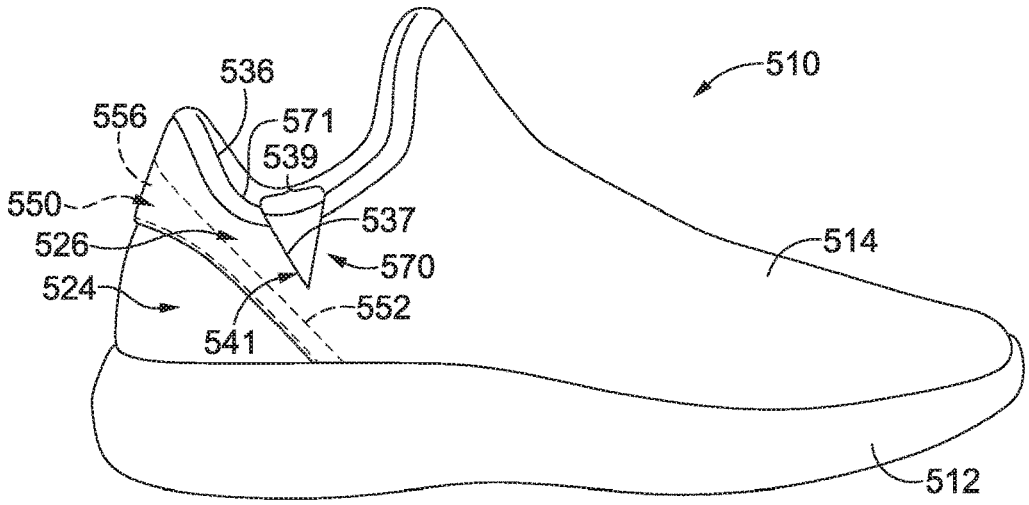
Figure 7:
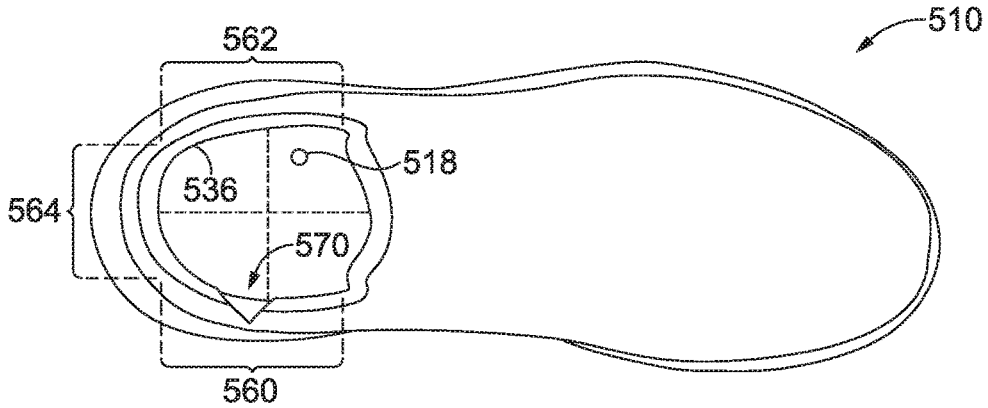

Further, as used in this disclosure, a "corresponding gusset" refers to a gusset having a substantially similar configuration as another gusset, including a similar size, shape, material, angular orientation, and position along the longitudinal orientation (i.e., front-to-back such that the gusset and the corresponding gusset are substantially aligned in the medial-to-lateral orientation). As stated above, in an aspect of this disclosure, a footwear article includes a gusset (e.g., 570) along the medial-side portion (e.g., 560) without a corresponding gusset along the lateral-side portion (e.g., 562). As such, along the lateral-side portion the footwear article may include a smaller gusset, a gusset constructed of a different material, a gusset positioned more forward or rearward, a gusset having a different angular orientation, or any and all combinations thereof. In a further example, the lateral-side portion of the footwear article may not include any gusset, as illustrated in FIGS. 5-7.

Figure 9:
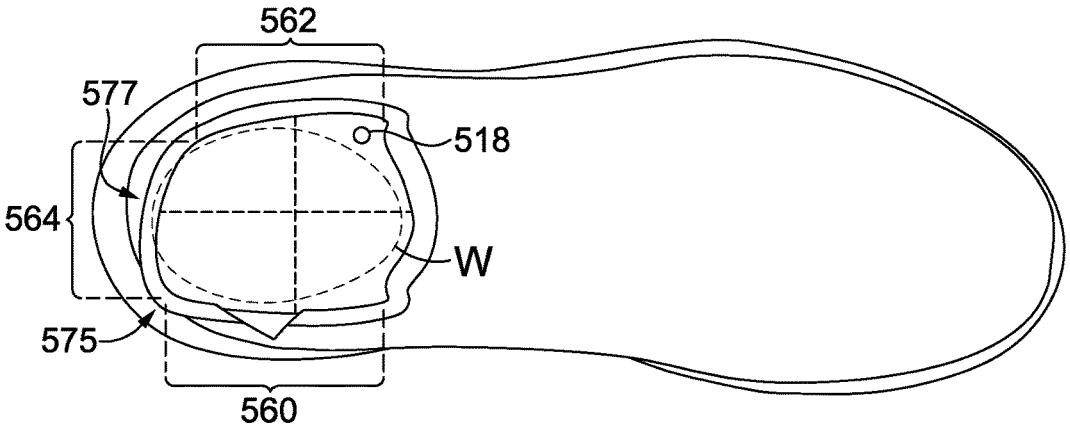
Figure 10:
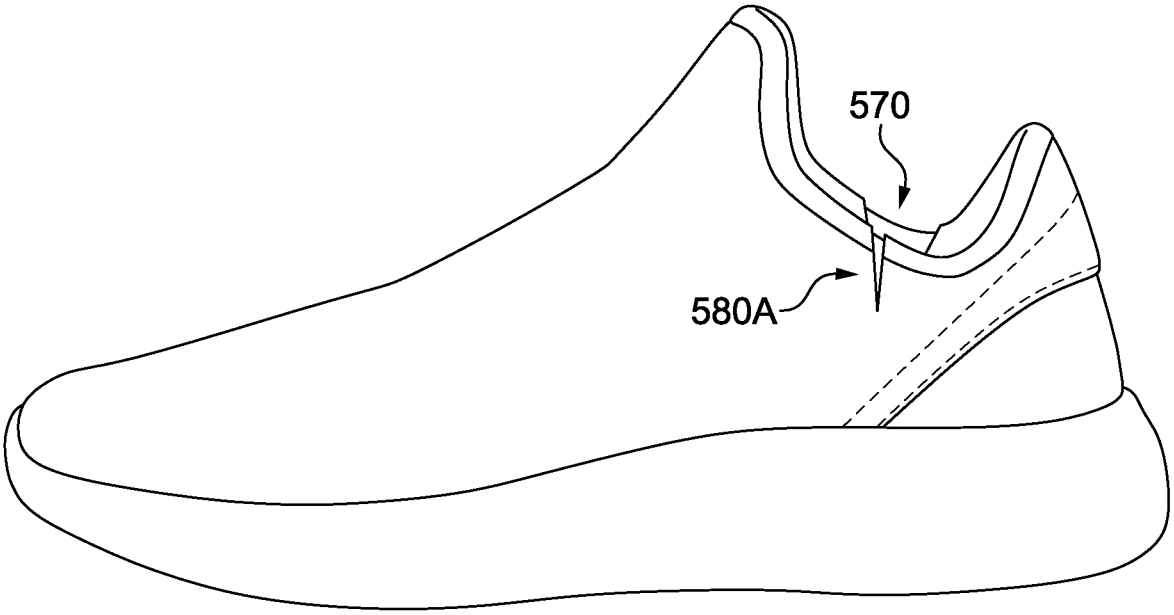
FIGS. 10-13 each depict a respective alternative footwear article in accordance with an aspect of this disclosure.
Figure 11:
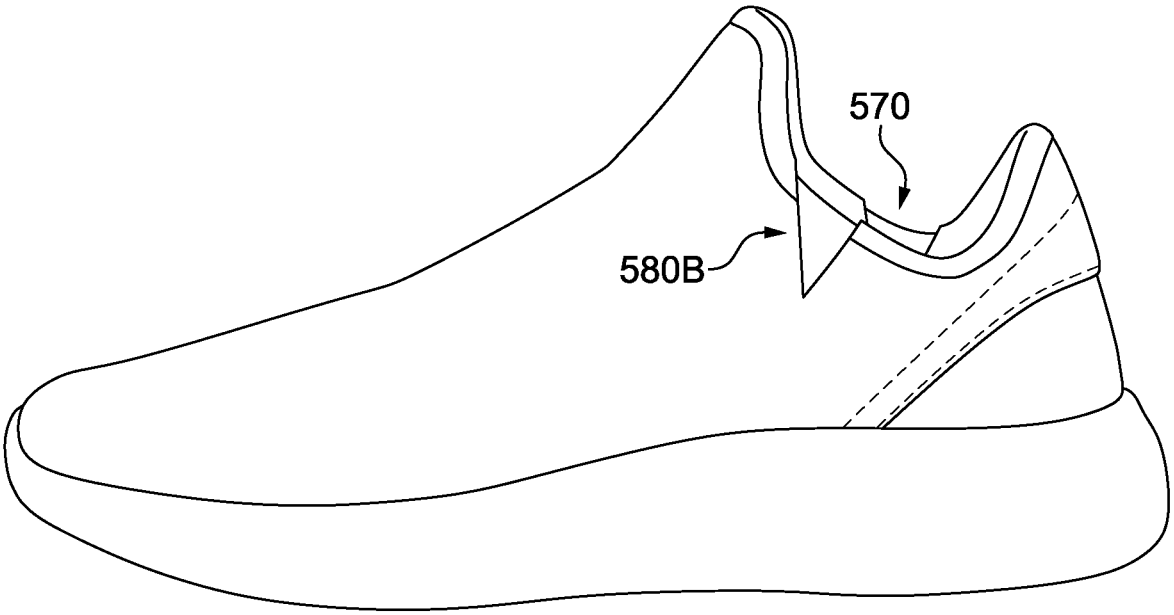

In accordance with an aspect of this disclosure, a footwear article having a gusset along the medial-side portion without a corresponding gusset along the lateral-side portion may operate in various manners. Referring to FIG. 9, a top view is depicted of the footwear article 510 with the ankle collar 536 in a more stretched state, such as when the ankle collar 536 is depressed. As compared with the at-rest state in FIG. 7, the ankle collar 536 in FIG. 9 has elongated more in the medial-side portion 560 than in the lateral-side portion 562. Varied elongation and expansion at differing portions of the ankle collar 536 may provide utility in various contexts. For example, the position of elongation elements (e.g., gussets) may be configured to correspond with donning/doffing techniques or limitations of some wearers. That is, in some instances, a wearer may more commonly depress on the ankle collar 236 at a position (e.g., 275) closer to the medial side than to the lateral side. A wearer might depress the ankle collar 236 at the position 275, as opposed to a more centrally located position, for various reasons. For example, a wearer may have limited dexterity and range-of-motion that may make the position 275 an easier target for depressing the ankle collar. In other instances, it may be more natural for a wearer to bank or twist the lateral portion of his or her foot (e.g., supination) downward as his or her foot is inserted through the foot-insertion opening, and this rotation may adjust his or her heel inward and more aligned with the position 275. In other instances, when doffing a footwear article, the wearer's heel may not be lifted along a path in direct alignment with the more centrally positioned location 277. For example, the heel might be pulled from the foot-insertion opening 518 along a path that is more aligned with the position 275, such that the expansion along the medial-side portion 560 is positioned to facilitate easier footwear removal.

In other instances, a wearer may still apply depression forces in the more centrally positioned location 277, and not including a corresponding gusset along the lateral-side portion 264 may preserve the structure of the lateral-side portion 264 for other purposes. For example, when a corresponding gusset is not included along the lateral-side portion 264, then a selected esthetic of lateral-side portion 264 (and the ankle region 526 and heel region 524) may be preserved or different functional elements may be included within the lateral-side upper that might otherwise be disrupted by a corresponding gusset. Examples of different functional elements might include a textile having a stiffness, an amount of breathability, an amount of insulation, an amount of water resistance, and the like.

Figure 12:
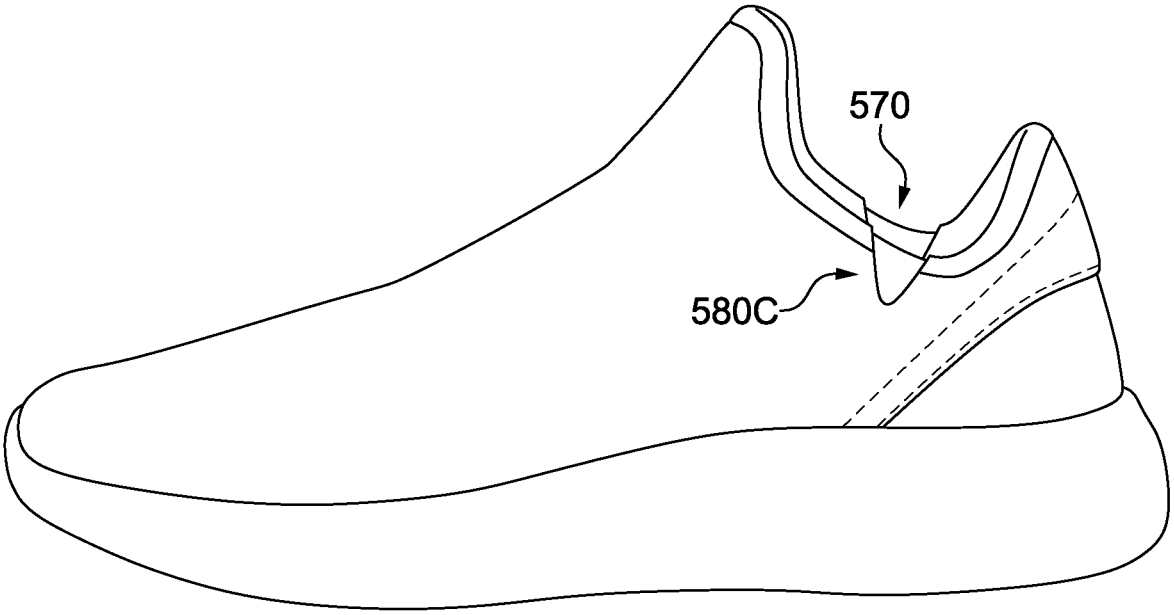
Figure 13:
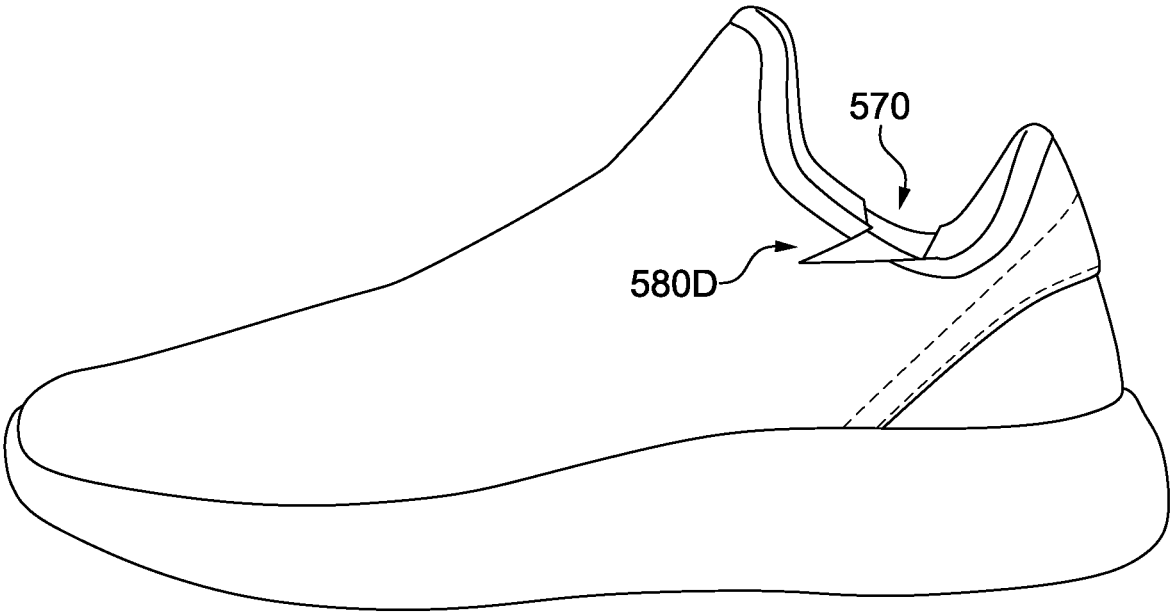

FIGS. 5-9 depict one example in which the lateral-side portion 562 does not include any gusset. In other aspects, the lateral-side portion may include a gusset that is not a corresponding gusset, since the gusset on the lateral side includes a different size, a different shape, a position, a different angular orientation, a different material, or any combination thereof. For example, in FIG. 10 the lateral-side gusset 580A is not a corresponding gusset, relative to the medial-side gusset 570, because the lateral-side gusset 580A is smaller (i.e., narrower), even though the lateral-side gusset 580A and the medial-side gusset 570 are aligned in the medial-to-lateral orientation and include similar angular orientations. In another example, provided by FIG. 11, the lateral-side gusset 580A includes a different longitudinal position than the gusset 270, such that the gussets 580A and 570 are not latitudinally aligned in the medial-to-lateral orientation. As such, gusset 580/*b* is not a corresponding gusset even though it has a similar size, shape, and angular orientation. FIG. 12 provides another example, and the lateral-side gusset 580C is not a corresponding gusset, relative to the medial-side gusset 570, because the lateral-side gusset 580C has a different shape, even though the lateral-side gusset 580C and the medial-side gusset 570 are aligned in the medial-to-lateral orientation and include similar size and angular orientations. In FIG. 13, the lateral-side gusset 580D is not a corresponding gusset, relative to the medial-side gusset 570, because the lateral-side gusset 580D has a different angular orientation. The angular orientation of a gusset may be determined in various manners. For example, a reference line may extend from the midpoint of a gusset base to the midpoint of a gusset mouth, and angle may be measured at which the reference line intersects a horizontal reference plane (e.g., flat ground surface on which the ground-contacting surface sits in an at-rest position). FIGS. 10-13 are merely examples of some various footwear article with collar elevators and with asymmetric ankle collars, and in other aspects, a non-corresponding gusset on the lateral side may have other differences as compared with a medial-side gusset.

Figure 14:
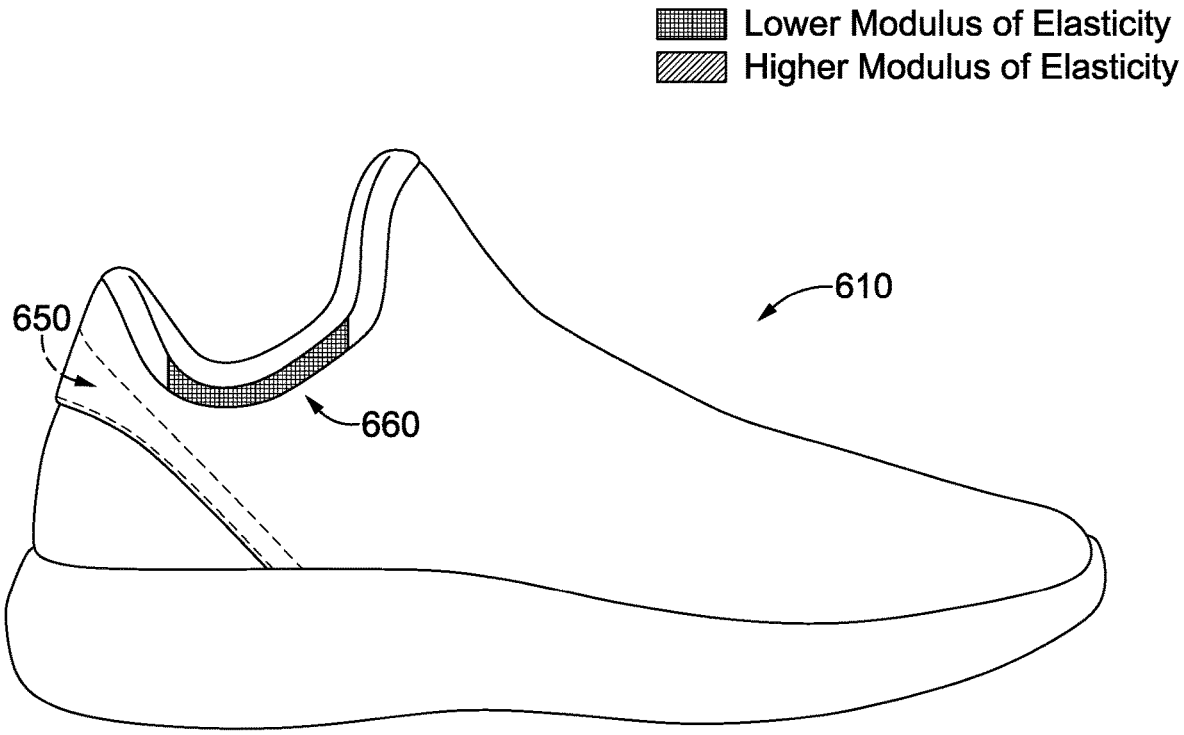
FIGS. 14-15 depict another footwear article in accordance with an aspect of this disclosure.
Figure 15:
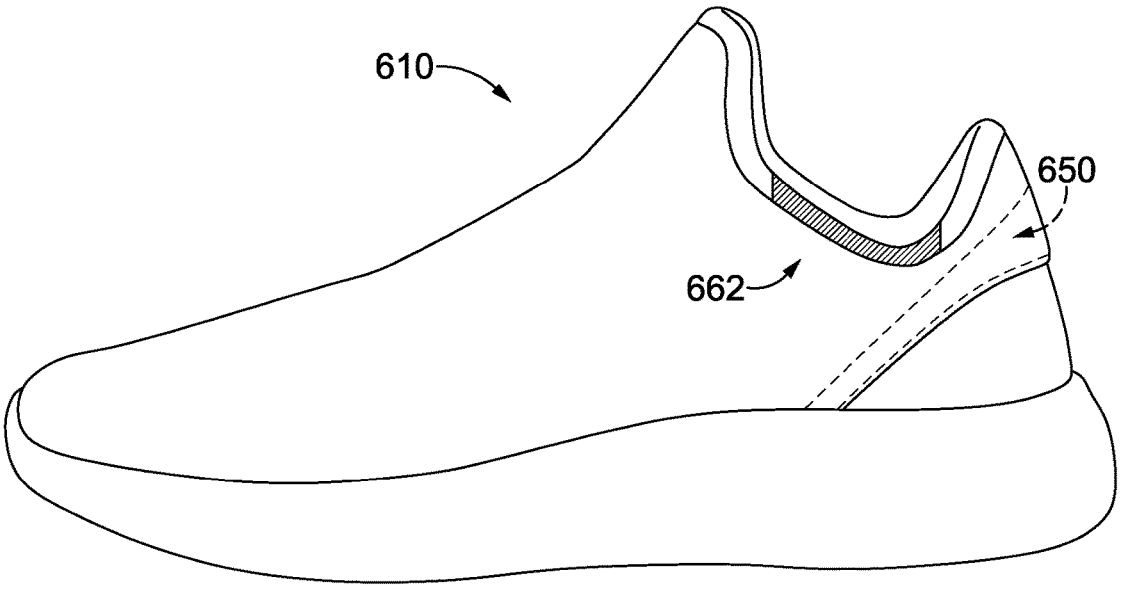

As indicated in other portions of this disclosure, the ankle collar 536 is asymmetric and includes a first set of structures or properties in the medial-side portion 560 that are different from a second set of structures or properties in the lateral-side portion 562. FIGS. 5-13 illustrate some aspects in which the footwear article includes a gusset along the medial-side portion 560 without a corresponding gusset along the lateral-side portion 562. The ankle collar 536 may be asymmetric in other ways, as well. For example, referring to FIGS. 14 and 15 an alternative footwear article 610 is depicted having a collar elevator 650. In addition, the medial-side portion 660 may include a first upper construction having a first set of one or more materials arranged in one or more material layers, and the lateral-side portion 662 may include a second upper construction having a second set of one or more materials arranged in one or more material layers. In accordance with an aspect of this disclosure, the first upper construction may include different material properties than the second upper construction. Examples of material properties that might differ include a modulus of elasticity or a stiffness. These properties might be measured using one or more standards or testing methodologies determined to be appropriate by an ordinary skilled artisan. For example, a modulus of elasticity of the first upper construction and the second upper construction might be measured pursuant to ASTM WK 27572 (initiated on Feb. 11, 2010), ASTM D5034, or a similar testing methodology. If ASTM D5034 is applied, then in one aspect the longer side of the test specimens would align in the fore-to-aft orientation along the upper.

In a further aspect, the first upper construction of the medial-side portion 660 includes a lower modulus of elasticity than the second upper construction. In another aspect, the first upper construction of the medial-side portion 660 is more flexible than the second upper construction. Furthermore, the medial-side portion 660 might be both more elastic and more flexible than the lateral-side portion 662. Greater elasticity, greater flexibility, or a combination thereof may contribute to an operation of the footwear article 610 in various ways. For example, the ankle-collar asymmetry including greater elasticity and/or greater flexibility along the medial-side portion 660 might facilitate more expansion along the medial side during donning and doffing, similar to the operation described with respect to FIG. 9.

The first construction may be different from the second construction in various ways. For example, the first construction may include a first knit structure and the second construction may include a second knit structure. The first knit structure may include a stitch size or a stitch type that contributes to the lower modulus of elasticity, the more flexibility, or the combination thereof. In another example, the first construction may include a material with higher elastic yarn content, the second construction may include one or more additional material layers not included in the first construction, or a combination thereof.

Figure 16:
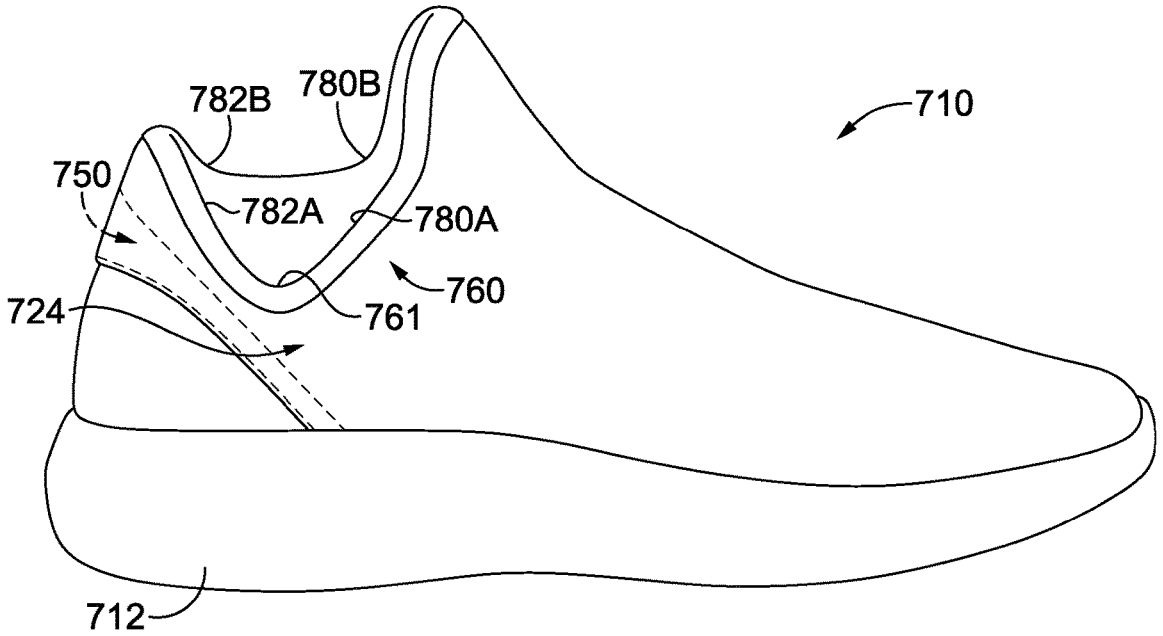
FIGS. 16-17 depict another footwear article in accordance with an aspect of this disclosure.
Figure 17:
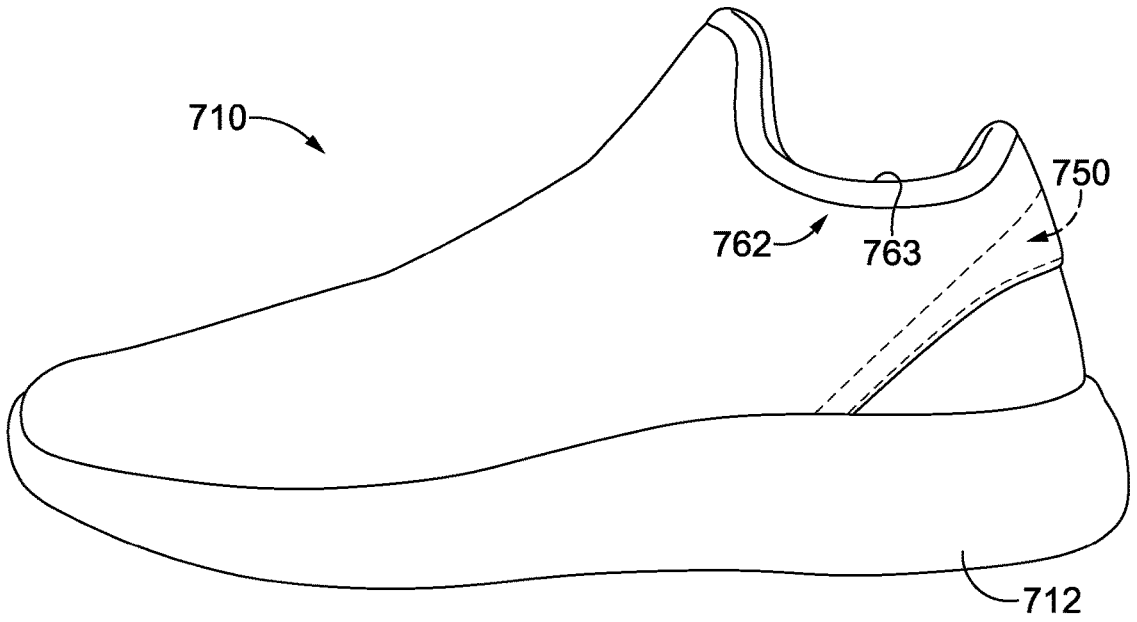

In another alternative example, referring to FIGS. 16 and 17, another footwear article 710 is depicted having a collar elevator 750. In addition, the medial-side portion 760 of the ankle collar includes a medial-side topline edge 761, and the lateral-side portion 762 includes a lateral-side topline edge 763. In an aspect of the disclosure, the ankle collar 736 is asymmetric based on the differences between the medial-side topline edge 761 and the lateral-side topline edge 763. For example, the medial-side topline edge 761 has a valley that dips downward more aggressively towards the sole 712 as it extends from an anterior portion to a posterior portion. In contrast, the lateral-side topline edge 763 extends more horizontally without an aggressive dip as the lateral-side topline edge 763 extends anteriorly to posteriorly. The topline edges 761 and 763 may be compared in various manners. For example, the inferior most portion of the medial-side topline edge 761 is closer to the sole 712 than the inferior most portion of the lateral-side topline edge. In addition, the medial-side topline edge 761 is longer than the lateral-side topline edge 763. For example, if a first medial-to-lateral reference plane extends through points 780A and 780B and a second medial-to-lateral reference plane, which is parallel to the first, extends through points 782A and 782B, then a length of the medial-side topline edge 761 between the planes is longer than a length of the lateral-side topline edge 763 between the planes.

The more inferior portion of the medial-side topline edge 761, the longer length of the medial-side topline edge 761, or a combination thereof may contribute to an operation of the footwear article 710 in various ways. For example, the ankle-collar asymmetry including the differences in the topline edges 761 and 763 might facilitate more expansion along the medial side during donning and doffing, similar to the operation described with respect to FIG. 9. In operation, when the ankle collar undergoing a depression cycle (such as during a hands-free donning operation when the foot is pressing down on the ankle collar) the straighter and more superior lateral-side topline edge 763 may provide tension and resistance to rearward collapsing earlier in the depression cycle (and throughout the depression cycle), as compared with the medial-side topline edge 761, which may be more susceptive to deformation in the medial-side, heel portion of the upper 724.

Some aspects of this disclosure have been described with respect to the examples provided in the figures. Additional aspects of the disclosure will now be described that may be related subject matter included in one or more claims or clauses of this application at the time of filing, or one or more related applications, but the claims or clauses are not limited to only the subject matter described in the below portions of this description. These additional aspects may include features illustrated by the figures, features not illustrated by the figures, and any combination thereof. When describing these additional aspects, reference may be made to elements depicted by the figures for illustrative purposes.

An aspect of this disclosure is directed to a footwear article comprising a sole. The footwear article also comprises an upper coupled to the sole, which as a heel region and an ankle region. Additionally, the footwear article comprises an ankle collar positioned in the ankle region. The ankle collar includes an ankle-collar medial side and an ankle-collar lateral side, wherein the ankle collar is movable between a lowered state positioned closer to the sole and a raised state positioned farther from the sole. The footwear article comprises a collar elevator positioned in at least the heel region and operable to move the ankle collar from the lowered state to the raised state. Furthermore, the footwear article comprises a gusset positioned along the ankle-collar medial side without a corresponding gusset along the ankle-collar lateral side.

Another aspect of this disclosure is directed to a footwear article comprising a sole. The footwear article also comprises an upper coupled to the sole, which as a heel region and an ankle region. The footwear article comprises an ankle collar positioned in the ankle region as well. The ankle collar consists of an ankle-collar medial side and an ankle-collar lateral side, wherein the ankle collar is movable between a lowered state positioned closer to the sole and a raised state positioned farther from the sole. The ankle-collar medial side includes a medial-side topline edge and the ankle-collar lateral side includes a lateral-side topline edge, which does not mirror the medial-side topline edge. Further, the footwear article comprises a collar elevator positioned in at least the heel region, which is operable to move the ankle collar from the lowered state to the raised state.

In addition, an aspect of this disclosure is directed to a footwear article comprising a sole. The footwear article also comprises an upper coupled to the sole, which has a heel region and an ankle region with an ankle collar. The ankle collar includes an ankle-collar medial side and an ankle-collar lateral side. The ankle-collar medial side, in response to an applied force, comprises a lower modulus of elasticity, more flexibility, or a combination thereof, than the ankle-collar lateral side. The ankle collar is reversibly movable from a raised state positioned farther from the sole to a lowered state positioned closer to the sole in response to the applied force. Additionally, the footwear article comprises a collar elevator positioned in the heel region and operable to move the ankle collar from the lowered state to the raised state when the applied force is removed.

From the foregoing, it will be seen that this invention is one well adapted to attain all the ends and objects hereinabove set forth together with other advantages which would be realized by an ordinary skilled artisan and which are inherent to the structure.

It will be understood that certain features and subcombinations are of utility and may be employed without reference to other features and subcombinations. This is contemplated by and is within the scope of the claims.

Since many possible aspects may be made of the invention without departing from the scope thereof, it is to be understood that all matter herein set forth or shown in the accompanying drawings is to be interpreted as illustrative and not in a limiting sense.

As used herein and in connection with the claims listed hereinafter, the terminology "any of clauses" or similar variations of said terminology is intended to be interpreted such that features of claims/clauses may be combined in any combination. For example, an exemplary clause 4 may indicate the method/apparatus of any of clauses 1 through 3, which is intended to be interpreted such that features of clause 1 and clause 4 may be combined, elements of clause 2 and clause 4 may be combined, elements of clause 3 and 4 may be combined, elements of clauses 1, 2, and 4 may be combined, elements of clauses 2, 3, and 4 may be combined, elements of clauses 1, 2, 3, and 4 may be combined, and/or other variations. Further, the terminology "any of clauses" or similar variations of said terminology is intended to include "any one of clauses" or other variations of such terminology, as indicated by some of the examples provided above.

The following clauses are aspects contemplated herein.

Clause 1. A footwear article comprising: a sole; an upper coupled to the sole and having a heel region and an ankle region; an ankle collar positioned in the ankle region and having an ankle-collar medial side and an ankle-collar lateral side, wherein the ankle collar is movable between a lowered state positioned closer to the sole and a raised state positioned farther from the sole; a collar elevator positioned in at least the heel region and operable to move the ankle collar from the lowered state to the raised state; and a gusset positioned along the ankle-collar medial side without a corresponding gusset along the ankle-collar lateral side.

Clause 2. The apparatus of any of the clauses, wherein the collar elevator stores potential energy by elastically deforming from a first configuration to a second configuration when an applied force moves the ankle collar from the raised state to the lowered state, and wherein the potential energy returns the collar elevator to the first configuration upon removal of the applied force.

Clause 3. The apparatus of any of the clauses, wherein the collar elevator includes a medial lever arm, a lateral lever arm, and a center connecting band that couples the medial lever arm to the lateral lever arm and that is located in a rear portion of the ankle collar.

Clause 4. The apparatus of any of the clauses, wherein ankle-collar lateral side does not include a gusset.

Clause 5. The apparatus of any of the clauses, wherein the ankle-collar lateral side includes a non-corresponding gusset that is smaller than the gusset.

Clause 6. The apparatus of any of the clauses, wherein the ankle-collar lateral side includes a non-corresponding gusset comprising a first material, which is less elastic than a second material of the gusset.

Clause 7. The apparatus of any of the clauses, wherein the ankle-collar lateral side includes a non-corresponding gusset that is positioned more anterior than the gusset.

Clause 8. The apparatus of any of the clauses, wherein the ankle-collar lateral side includes a non-corresponding gusset having a different angular orientation than the gusset.

Clause 9. The apparatus of any of the clauses, wherein the ankle-collar lateral side includes a non-corresponding gusset having a different shape than the gusset.

Clause 10. A footwear article comprising: a sole; an upper coupled to the sole and having a heel region and an ankle region; an ankle collar positioned in the ankle region and having an ankle-collar medial side and an ankle-collar lateral side, wherein the ankle collar is movable between a lowered state positioned closer to the sole and a raised state positioned farther from the sole, wherein the ankle-collar medial side includes a medial-side topline edge and the ankle-collar lateral side includes a lateral-side topline edge, which does not mirror the medial-side topline edge; and a collar elevator positioned in at least the heel region and operable to move the ankle collar from the lowered state to the raised state.

Clause 11. The apparatus of any of the clauses, wherein the medial-side topline edge includes a first topline-edge portion extending from an anterior position to a posterior position, wherein the lateral-side topline edge includes a second topline-edge portion extending from the anterior portion to the posterior portion, and wherein the first topline-edge portion includes a deeper valley than the second topline-edge portion.

Clause 12. The apparatus of any of the clauses, wherein a most inferior portion of the first topline-edge portion is closer to the sole than a most inferior portion of the second topline-edge portion.

Clause 13. The apparatus of any of the clauses, wherein the first topline-edge portion is longer than the second topline-edge portion.

Clause 14. A footwear article comprising: a sole; an upper coupled to the sole and having a heel region and an ankle region with an ankle collar; the ankle collar comprising an ankle-collar medial side and an ankle-collar lateral side, wherein in response to an applied force, the ankle-collar medial side comprises a lower modulus of elasticity, more flexibility, or a combination thereof, than the ankle-collar lateral side; wherein the ankle collar is reversibly movable from a raised state positioned farther from the sole to a lowered state positioned closer to the sole in response to the applied force; and a collar elevator positioned in the heel region and operable to move the ankle collar from the lowered state to the raised state when the applied force is removed.

Clause 15. The apparatus of any of the clauses, wherein the ankle-collar medial side includes a first knit structure, wherein the ankle-collar lateral side includes a second knit structure, and wherein the first knit structure includes a stitch size or a stitch type that contributes to the lower modulus of elasticity, the more flexibility, or the combination thereof.

Clause 16. The apparatus of any of the clauses, wherein the ankle-collar medial side includes one or more medial-side textiles and the ankle-collar lateral side includes one or more lateral-side textiles, and wherein the one or more medial-side textiles include a higher elastic-yarn content than the one or more lateral-side textiles.

The invention claimed is:

1. A footwear article comprising:

a sole;

an upper coupled to the sole and having a heel region and an ankle region;

an ankle collar positioned in the ankle region and having an ankle-collar medial side and an ankle-collar lateral side, wherein the ankle collar is movable between a lowered state positioned closer to the sole and a raised state positioned farther from the sole, and wherein the ankle-collar medial side includes a v-shaped notch along a topline edge of the ankle collar, the v-shaped notch tapering from a wider mouth along the topline edge to a narrower base as the v-shaped notch extends from the topline edge towards the sole;

a collar elevator positioned in at least the heel region and operable to move the ankle collar from the lowered state to the raised state; and a gusset positioned along the ankle-collar medial side without a corresponding gusset along the ankle-collar lateral side, the gusset comprising a panel of elastic material spanning the v-shaped notch.

2. The footwear article of claim 1, wherein the collar elevator is configured to store potential energy by elastically deforming from a first configuration to a second configuration when an applied force moves the ankle collar from the raised state to the lowered state, and wherein the potential energy returns the collar elevator to the first configuration upon removal of the applied force.

3. The footwear article of claim 2, wherein the collar elevator includes a medial lever arm, a lateral lever arm, and a center connecting band that couples the medial lever arm to the lateral lever arm and that is located in a rear portion of the ankle collar.

4. The footwear article of claim 1, wherein the ankle-collar lateral side does not include a gusset.

5. The footwear article of claim 1, wherein the ankle-collar lateral side includes a non-corresponding gusset that is smaller than the gusset.

6. The footwear article of claim 1, wherein the ankle-collar lateral side includes a non-corresponding gusset comprising a first material, which is less elastic than a second material of the gusset.

7. The footwear article of claim 1, wherein the ankle-collar lateral side includes a non-corresponding gusset that is positioned more anterior than the gusset.

8. The footwear article of claim 1, wherein the ankle-collar lateral side includes a non-corresponding gusset having a different angular orientation than the gusset.

9. The footwear article of claim 1, wherein the ankle-collar lateral side includes a non-corresponding gusset having a different shape than the gusset.

10. The footwear article of claim 1, wherein the narrower base is positioned between the wider mouth and the sole.

11. The footwear article of claim 1, wherein, when a force is applied in a rearward direction aligned with a longitudinal orientation of the footwear article, the heel region of the upper rotates downwardly towards the sole.

* * * * *